US006044918A

United States Patent [19]

Noser et al.

[11] Patent Number: 6,044,918

[45] **Date of Patent: *Apr. 4, 2000**

[54] PERCUSSION BLOW ADDED MANUALLY OPERABLE DRILLING TOOL

[75] Inventors: Otto Noser, Vaduz; Alexander Hoop, Schaan, both of Liechtenstein; Ulrich Bourgund, Wiedergeltingen, Germany; Hanspeter Schad, Grabs, Switzerland; Stefan Miescher, Eschen; Edwin Schweizer, Balzers, both of Liechtenstein

[73] Assignee: Hilti Aktiengesellschaft, Schaan, Liechtenstein

[ * ] Notice: This patent issued on a continued prosecution application filed under 37 CFR 1.53(d), and is subject to the twenty year patent term provisions of 35 U.S.C. 154(a)(2).

[21] Appl. No.: 08/716,925

[22] Filed: Sep. 20, 1996

[30] Foreign Application Priority Data

Sep. 20, 1995 [DE] Germany ..... 195 34 850

[51] Int. Cl.[7] ..... B25B 23/14

[52] U.S. Cl. ..... 173/176; 173/2; 173/180; 173/182

[58] Field of Search ..... 173/2, 7, 8, 176, 173/180, 181, 182, 179, 201, 217, 200, 178, 1; 408/12, 9; 73/862.29, 862.31

[56] References Cited

U.S. PATENT DOCUMENTS

| | | | |
|---|---|---|---|
| 4,165,789 | 8/1979 | Rogers | 175/27 |
| 4,316,512 | 2/1982 | Kibblewhite | 173/12 |
| 4,384,493 | 5/1983 | Grunbaum | 73/862.29 |
| 4,487,270 | 12/1984 | Huber | 173/12 |
| 4,534,420 | 8/1985 | Goldelius | 173/12 |
| 4,540,318 | 9/1985 | Hornung | 408/9 |
| 4,613,800 | 9/1986 | Jeppsson | 318/434 |
| 4,660,656 | 4/1987 | Warren et al. | 173/8 |
| 4,669,551 | 6/1987 | Lippacher | 173/109 |
| 4,745,557 | 5/1988 | Pekar | 408/9 |
| 4,820,962 | 4/1989 | Millauer | 318/602 |
| 4,854,786 | 8/1989 | Alexander | 408/9 |
| 5,014,793 | 5/1991 | Germantown | 173/12 |
| 5,116,168 | 5/1992 | Aihara | 408/9 |
| 5,172,774 | 12/1992 | Melrose | 173/182 |
| 5,361,852 | 11/1994 | Inoue | 173/176 |
| 5,584,619 | 12/1996 | Guzzella | 408/9 |

FOREIGN PATENT DOCUMENTS

| | | |
|---|---|---|
| 0107629 | 8/1983 | European Pat. Off. . |
| 0203282 | 3/1986 | European Pat. Off. . |
| 1992941 | 8/1958 | Germany . |
| 1912440 | 4/1965 | Germany . |
| 2160320 | 5/1985 | United Kingdom . |

*Primary Examiner*—Peter Vo
*Assistant Examiner*—James P. Calve
*Attorney, Agent, or Firm*—Brown & Wood, LLP

[57] ABSTRACT

A percussion blow added manually operable drilling tool, such as a hammerdrill, has a housing (2) containing an electric motor for rotating a tool bit chuck (9) about its axis, a control device (C) for controlling the rpm of the chuck (9) operated by the electric motor (3) which is activated by a switch (5) located on the exterior of the housing (2), and a percussion blow mechanism for periodically applying axially directed blows to a bit (10) secured in the chuck (9). The electric motor (3) is coupled to a device (12) for measuring the reaction torque. The control device (C) is connected to an evaluation unit (E) which is connected to the device (12) for measuring the reaction torque so that the rpm of the chuck can be regulated from maintaining the measured reaction torque at a maximum.

7 Claims, 3 Drawing Sheets

PERCUSSION BLOW ADDED MANUALLY OPERABLE DRILLING TOOL

BACKGROUND OF THE INVENTION

The present invention is directed to a percussion blow added manually operable drilling tool, such as a hammerdrill, having a housing with a chuck and an electric motor within the housing for rotatably driving the chuck about its axis of rotation. A control device located within the housing for controlling the rpm of the chuck. A switch positioned on the housing for operating the electric motor and a percussion blow mechanism within the housing for periodically directing percussion blows to a bit secured in the chuck.

Percussion blow added or assisted manually operable drilling tools are used in the construction industry in installation operations and in the electrical trade and related trades. Due to the higher removal rate in hard materials being drilled, such as concrete, masonry and rock, hammerdrills have given particularly good results in professional use. Hammerdrills have a continuously driven chuck and a motor actuated percussive blow mechanism. In operation, percussion blow mechanisms automatically transmit blows in timed sequence to a bit clamped in the chuck for assisting in the removal of the material being drilled. At the same time, the bit inserted in the chuck is continuously rotated to produce a borehole for dowels in the receiving material. In known hammerdrills, with large material removal, for instance in a series of tools provided by Hilti AG, the percussion blow mechanism is an electropneumatic device which transmits axially directed blows to the tool bit during tool operation.

Each percussion blow drives the cutting edge of the bit tip into the material being worked and produces a small notch. Due to the continuous rotation of the bit, the material is sheared off. The angle swept by the cutting edge at the tip of the bit of the continuously rotating chuck between two blows is designated as the translation angle or angle of rotation. The translation angle is selected in such a way in known hammerdrills that a periodic repetition occurs only after several complete turns. In this way it is avoided that the cutting edge of the bit strikes against already existing notches in direct sequence and thus deepens these notches further. In case of periodic translation angles, such as 30°, 36°, 45°, 52°, 62° and the like, the notches can be deepened to such an extent that the shearing action only removes an inadequate amount of material and the drilling output of the tool is greatly reduced. For this reason, such periodic translation angles are avoided by suitable design of the gear box in the hammerdrill.

SUMMARY OF THE INVENTION

While with known percussion blow added or assisted manually operable controlling tools, such as hammerdrills, it is possible to obtain good material removal, nevertheless it should be attempted to improve material removal, in particular in materials which fail due to brittleness. Therefore, in the present invention a percussion blow added or assisted manually operated drilling tool is to be provided which can be operated with an optimum drilling output in various mineral materials. No additional operating steps are required in the present invention other than activating the tool.

In a percussion blow added manually operable drilling tool, an electric motor is located in the housing for rotating a chuck about its axis. A control device for the chuck can be activated by a switch located on the outside of the housing.

A percussion blow striking mechanism for periodically dispensing axially directed blows to the tool bit is secured in the chuck. The electric drive motor is coupled to a device for measuring the reaction torque. The control device includes an evaluation unit connected to the measuring device for the reaction torque, so that the rpm of the chuck can be regulated in such a way that during operation the reaction torque is at maximum or highest value.

Due to the invention, the drilling tool can be operated within an optimum performance range. It has been shown that at maximum or highest measured reaction torque, the drilling output is at the maximum. The tool is always operated in the optimum performance range independently of the material being drilled. No additional operating steps are required of the operator. By operating the drilling tool in the optimum performance range, the percussion blow assisted manually operable drilling tool is used extremely efficiently. The optimized drilling output shortens the time period required for preparing a suitable borehole for the installation of the dowels. This makes the operation of the tool more economical.

A particularly simple embodiment of the measuring device comprises wire strain gauges or load cells arranged in the suspension of the electric motor in the housing. The selected arrangement of the wire strain gauges or load cells does not involve any special design effort. Torque measurement by means of wire strain gauges or load cells is well known and can be performed with sufficiently high accuracy at loads to which blow assisted drilling tools are usually subjected.

Since the evaluation unit is connected to the memory unit, where different rpm ranges are registered and the control device is designed so that these rpms can be automatically set up with increased numbers of revolution in accordance with the evaluation unit, whereby after the control arrangement has been activated by the operator the selection of the optimum rpms with the maximum associated reaction torque is accomplished in a very short time. As a result, the reaction torque is determined, adjusted or set up for each rpm and is recorded in the memory unit. Subsequently, the control device automatically regulates and establishes the rpm of the chuck which corresponds to the highest value of the measured reaction torques. Such control is performed independently of the tool operator. The operator must activate the control arrangement only once, for instance, as up to now, by a push button or switch on the handle. After that, control occurs entirely automatically without any further intervention by the operator. The operator can only recognize by the noise of the electric motor that regulation or control is in progress.

The rpm ranges recorded in memory unit correspond preferably to translation angles in the ranges of 37° to 39°, 46° to 50°, 61°–65° and 91°–98°. The relationship between the translation angle and the rpm of the chuck or of the cutting edge tip of the bit secured in the chuck is defined by the following relationship:

Translation angle [°]=rpm [U/min]·360[°]·1/blow frequency [1/Hz].

This relationship serves for the approximate determination of the optimum rpm ranges for translation angles. During operation, the rpm ranges corresponding to the translation angles are run through and the various rpms are appropriately varied. Due to this, the reaction torque at the drive motor associated with each adjusted rpm is determined. Finally, the optimum rpm at which the drilling tool is to be operated is adjusted by the control arrangement to the rpm at which the highest torque is measured.

In another embodiment of the invention, various ideal rpms are recorded in the memory unit. The control device is arranged so that the ideal rpms can be automatically set up in accordance with the evaluation unit and the rpm of the drill bit can be varied respectively within a range of +5% of the ideal rpm. For each rpm, the associated reaction torque is measured and deposited in the memory unit. After that, the rpm of the chuck can be automatically adjusted within a close tolerance of ±1% to that rpm at which the maximum or highest reaction torque value was observed. In this embodiment of the invention, the ideal rpms correspond to translation angles of 38°, 48°, 63° and 95°, respectively with a tolerance of ±1°, whereby the interrelationship between the rpm and translation angle is established according to the equation stated above. In both embodiments of the invention, the rpm ranges are approximately predetermined where as high as possible a reaction torque is to be expected.

The blow frequency included in the equation between the translation angle and rpm chuck is not constant, particularly in the percussion blow added hammerdrill tools with electromagnetic striking mechanism, rather the equation varies with the rpm. However, this is of no importance for the approximate determination of the rpm ranges. In the course of operation of the tool of the present invention, control action of the rpm of the chuck is performed only as a function of the reaction torque, so that the dependency of the rpm upon low frequencies is not significant in this case.

In another embodiment of the invention the evaluation unit includes a microprocessor which is activated so that the setup of the rpm of the chuck is periodically monitored during operation in accordance with measured reaction torque. In the case of the detected deviations corresponding to rpms outside of the stated range limits, possibly subsequent regulation control is effected.

The method of operating a percussion blow supported manually operable drilling tool according to the invention is distinguished in that the reaction torque is periodically measured by the measuring device at the drive motor and that the measured values are conveyed to the evaluation unit. In another method step the rpm of the tool bit chuck is measured by the control device in combination with the evaluation unit in such a way that the measured reaction torque is at it highest or maximum value. The inventive method is distinguished by a simple control circuit, where essentially one single control operation has to be considered.

Preferably the control operation automatically sets up the rpm of the toolbit chuck, at which it is expected that the measured reaction torque is at its highest or maximum value. For this purpose the rpm values deposited in the memory unit are consecutively run through and the associated measured reaction torques are measured and fixed in the memory unit. The control device regulates the rpm of the toolbit chuck to the determined optimum rpm and monitors continuously whether the control condition is satisfied, meaning that the reaction torque measured at the drive motor is at a maximum or its highest value, and if necessary it regulates again. Thereby it is assured that the blow-supported drilling tool is always operated in the optimum performance range.

Additional advantages of the invention result from the following description of embodiment examples with reference to the drawings.

DETAILED DESCRIPTION OF THE INVENTION

Figure 1:
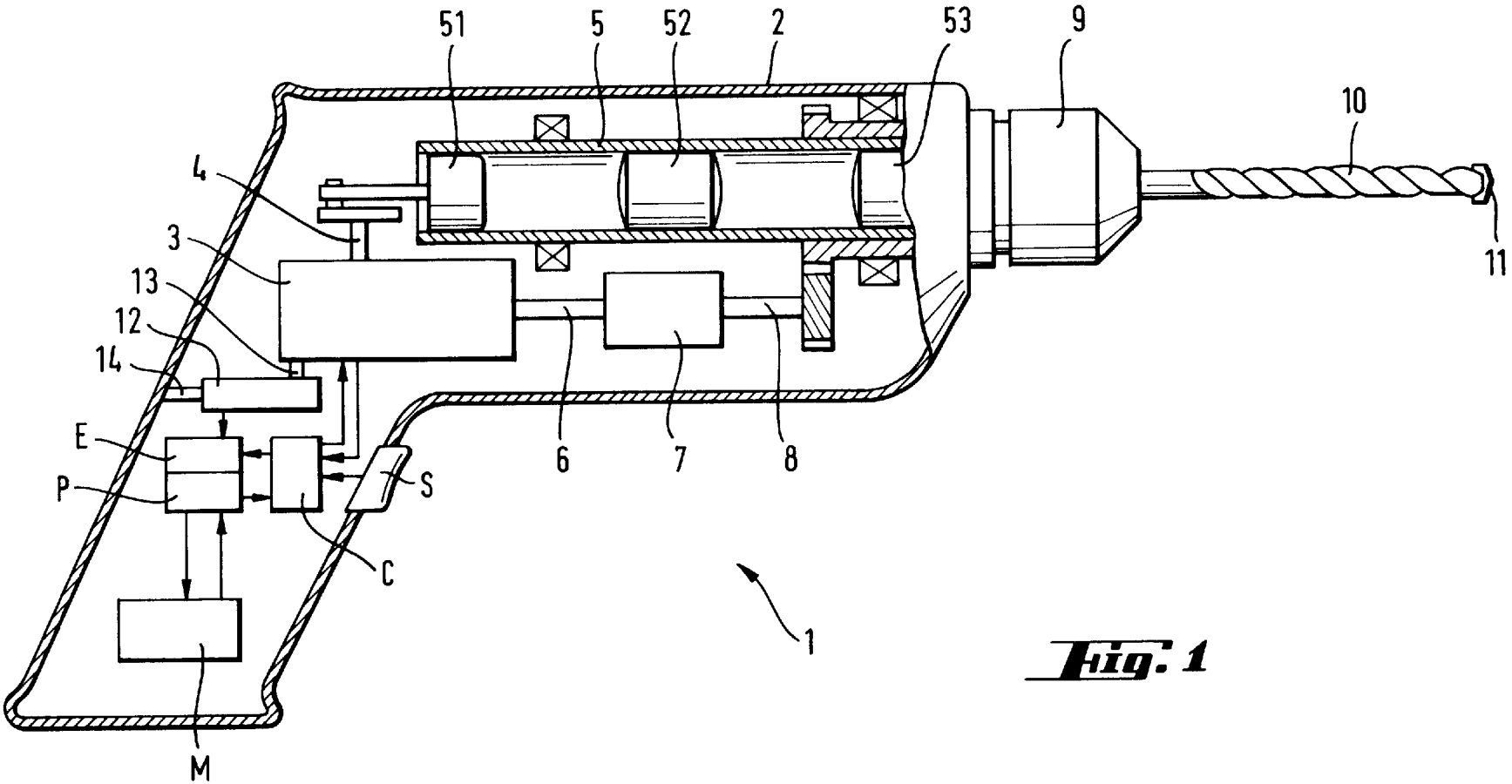
FIG. 1 is a sectional view of a manually operable drilling tool embodying the present invention and is shown partly schematically.

A manually operable drilling tool 1 with axially directed striking action embodying the present invention is shown in FIG. 1. Certain functional elements are shown diagrammatically and the tool is similar to a hammerdrill with an electropneumatic striking mechanism. The individual mechanical and electrical elements are located in a housing 2 and are shown as boxes including an electric drive motor 3, an electropneumatic striking mechanism 5, a gear box 7, and a chuck 9 in which a drilling bit 10 is secured. The connection of the mechanical elements is indicated by double lines. The electrical motor 3 is connected to the electropneumatic striking mechanism by a mechanical connection 4. The striking mechanism 5 includes an excitor piston 51 driven by an eccentric arrangement and accelerates a free piston 52 which strikes an anvil 53 and in turn delivers a percussion blow to the chuck 9 and transmits axially directed blows to the bit 10 secured in the chuck 9.

The electric drive motor 3 is connected by a second mechanical connection 6 to a gear box 7 in which the rpms of the electric motor are stepped up or down in a predetermined ratio. A further mechanical connection 8 transmits the rotary movement of the drive motor or of the gear box 7 to the chuck 9 and thereby continuously rotates the chuck about its axis during operation. The continuous rotary movement of the chuck 9 is transmitted to the bit 10 clamped in the chuck. Due to the overlap of the rotary movement and the axially directed blows at a cutting edge 11 on the tip of the bit 10, a borehole suitable for receiving a dowel can be prepared.

The tool 1 is operated by a switch S on the exterior of a handle part of the housing 1. The switch S closes the contact to the energy source which can be an accumulator or a power line to which the tool is connected by a supply line not shown, and the switch activates a control device C of the drive of the electric motor 3. In known hammerdrills 1, the rpm of the drive motor or of the chuck 9 connected to it can be regulated. The control device C comprises a known phase interface control.

According to the invention, the electric motor 3 is coupled to a measuring device 12 for a reaction torque and acts in operation on the drive motor 3. Preferably, the measuring device is formed of wire strain gages or load cells disposed in the suspension 13, 14 of the electric drive motor 3. Such wire strain gages or load cells can be procured from the firm of Hottinger Baldwin Messtechnik Gmbh, D 6100 Darmstadt 1. A suitable wire strain gage is described in that firm's prospectus #G 24.0107. In its other prospectus #G 21.04.9 apart from other devices, a load cell with the designation Z8 is described which can be used in the present arrangement.

The control device C includes an evaluation unit E connected to the measuring device 12 for the reaction torque. The electronic connections are symbolized by arrows in FIG. 1. The evaluation unit E processes the measured and digitalized reaction torques and causes the control arrangement of the control device C to regulate the rpm of the chuck 9 in such a way that the reaction torque measured in operation at the electric drive motor 3 is at a maximum or highest. The evaluation unit E is connected to a memory unit M in which measured data are stored temporarily. The memory unit can also be utilized for retrieving control information which it contains as will be explained more fully later. According to the illustrated embodiment, the evaluation unit E includes a microprocessor P which makes possible the specific sequence of the control regulation, as will be explained later.

Figure 2:
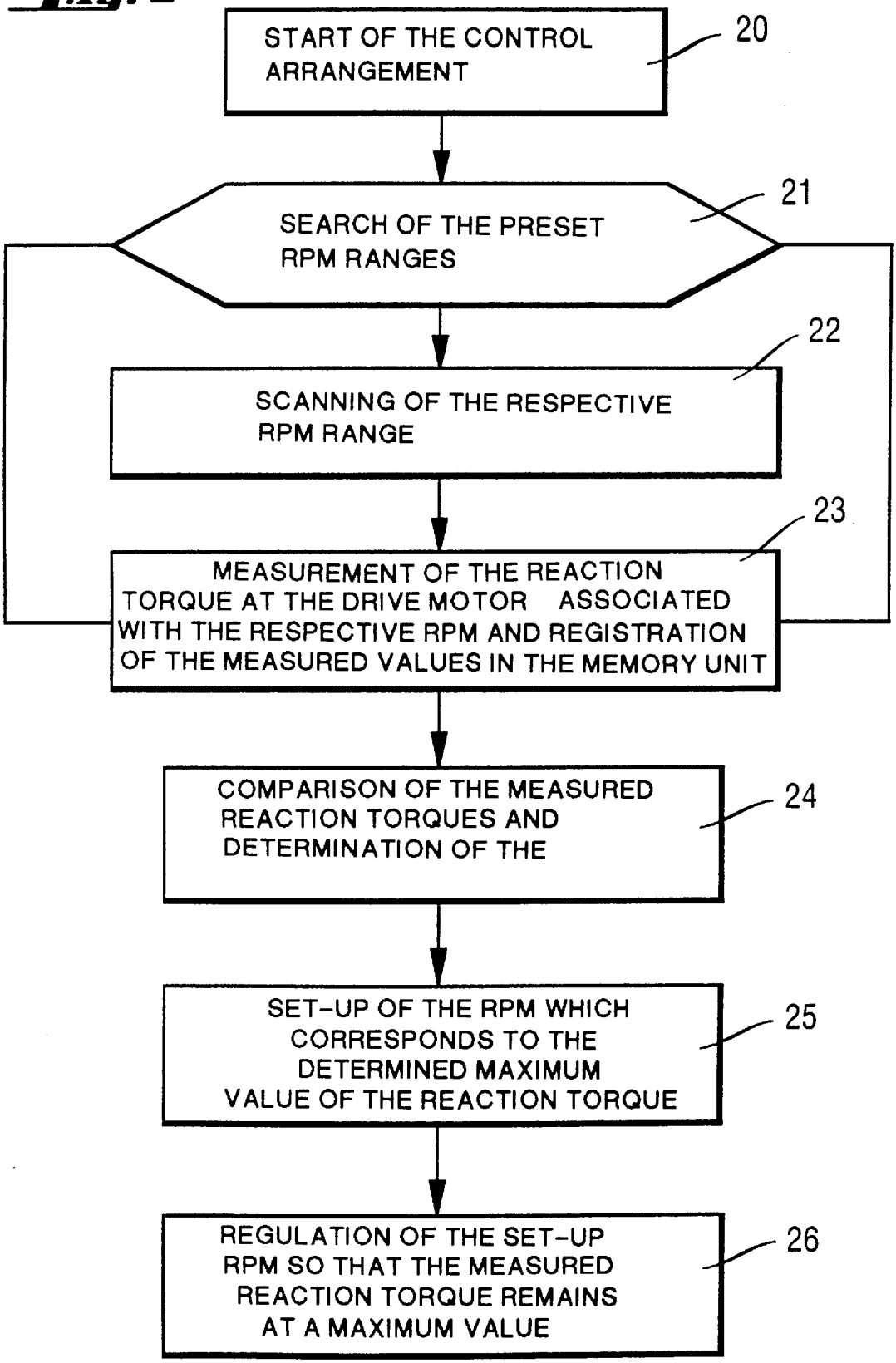
FIGS. 2 and 3 are box-type diagrams explaining the operation of the present invention.
Figure 3:
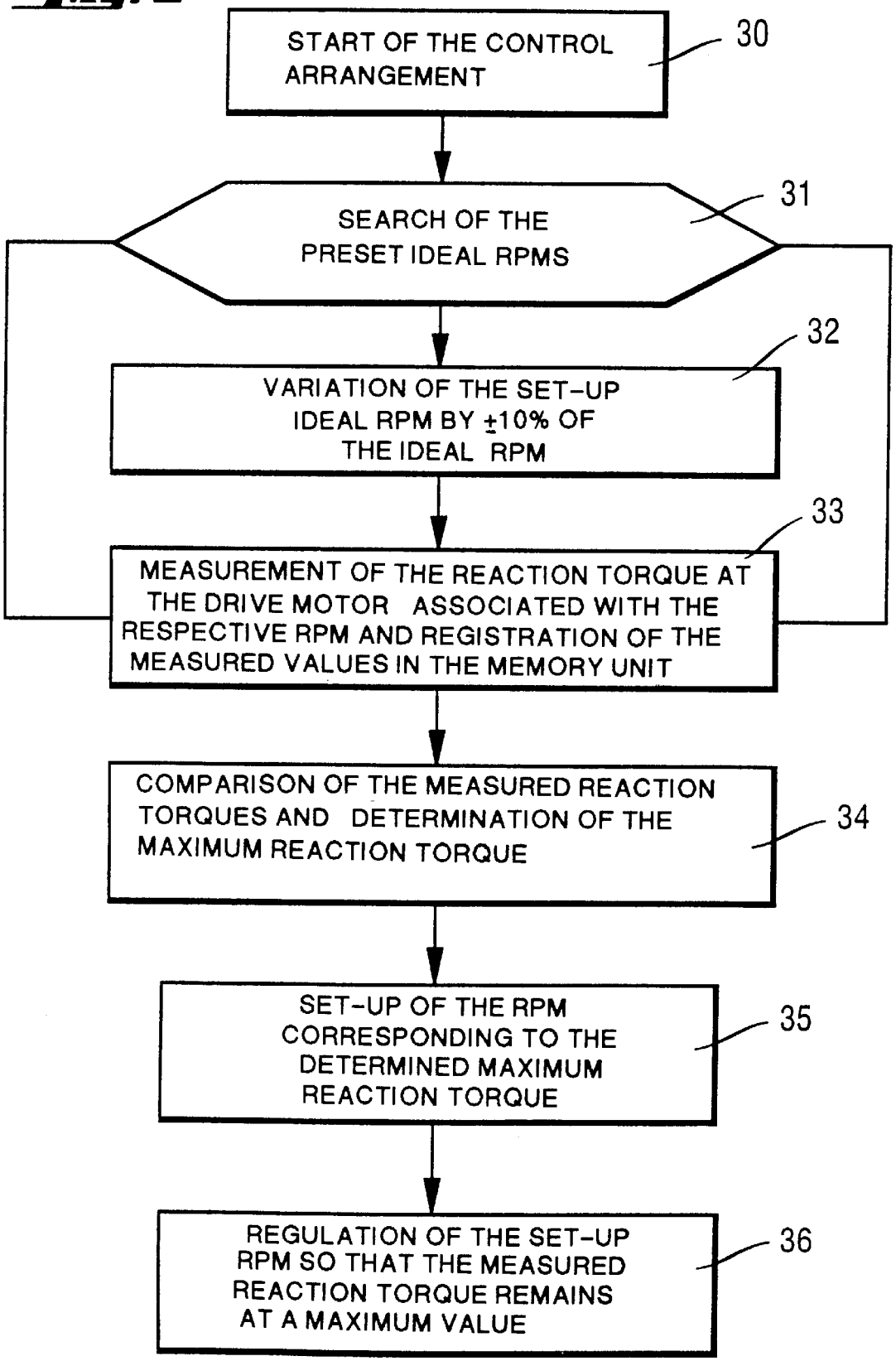

The two embodiments of the operational sequence of the rpm control of the chuck 9 are shown in FIGS. 2 and 3, by the boxes 20–26 and 30–36, and are defined by sequential instructions within the boxes 20–26 or 30–36. The control device C, box 20 or 30 is activated by operating the switch S at the handle portion of the housing 1. The control device C retrieves the control information stored in the memory unit M. In the embodiment of the invention according to the chart in FIG. 2, the control information states that the highest reaction torque can be found within a specific defined rpm ranges. The control device C controls the rpm consecutively in these rpm ranges and scans through them. A measuring action takes place by means of the measuring device 12 for the reaction torque at the electric drive motor 3, boxes 21–23, for each adjusted rpm. These measured and digitalized values are stored in the memory unit M and subsequently compared with one another. The maximum reaction torque is determined by comparing the measured reaction torques and the associated rpms of the chuck 9, 24. Subsequently, the control device C sets up the rpm, box 25, determined by the evaluation unit E and regulates the unit in such a way that the measured reaction torques remain at a maximum, box 26. In a preferred embodiment of the invention, the control information in the memory unit is arranged in such a way that the rpm ranges to be set up correspond to the translation angles 37°–39°, 46°–50°, 61°–65° and 91°–98°.

In the embodiment of the invention shown in the chart of FIG. 3, the control is effected in a very similar manner. In that arrangement, the control device C of the memory unit M retrieves the control information so that various ideal rpms are set consecutively. Each ideal rpm is then varied within a range of ±10% and the associated reaction torque is measured at the electric motor 3 for each rpm set up and the rpm is digitalized and temporarily stored in the memory unit M, boxes 31–33. Thus, as in the embodiment described above, there occurs a comparison of measured reaction torques, of the maximum value and the determination of the associated rpm box 34. The control device sets up the determined rpm box 35 and regulates it in such a way that the measured reaction torque remains at a maximum, box 36. In an advantageous embodiment of the invention, the control data in the memory unit M is selected so that the ideal rpms are to be set up corresponding to translation angles of 38°, 48°, 63°, and 95° with each having a tolerance of ±1°.

The relationship between the translation angle and the rpm of the chuck or of the cutting edge at the tip of a bit clamped in the chuck is given by the following equation.

$$\text{Translation angle } [°] = \text{rpm}[\text{U/min}] \cdot 360[°] \cdot 1/\text{blow frequency } [1/\text{Hz}].$$

This equation serves for the approximate determination of the optimum range or the ideal rpms. The frequency of the axially directed blows included in the equation of the relationship between the translation angle and the rpm is not a constant, especially in known hammerdrill tool 1 with only a single drive motor 3 for the chuck 9 and the electropneumatic striking mechanism 5, rather it changes with the rpm. This, however, is not significant for the approximate determination of the rpm ranges or the ideal rpms. In the case of separate drive motors for the chuck and the striking mechanism, the rpms of the chuck are decoupled from the axially directed blows, so that an exact determination is possible. In the course of operation of the inventive tool 1, the regulation of the rpm of the chuck 9 occurs only as a function of the reaction torque measured and the drive motor 3 so that in this instance the rpm depending on the striking mechanism is not important. Measuring of the reaction torque in rpm steps of 2 revolutions/minute is carried out for the determination of the optimal rpm.

The microprocessor P located at the evaluation unit E is advantageously controlled, so that adjustment of the rpm of the chuck 9 is periodically monitored during operation in accordance with the measured reaction torques; if deviations are detected, which include rpms outside the rpm range limits, a repeated control, if necessary, should be effected. The acquisition of reaction torques at the electric drive 3 occur at approximately 600 to 6,000 times per minute.

Due to the arrangement of the blow added manually operable drilling tool, it can be operated within an optimal performance range. As can be seen, the drilling output reaches a maximum at a maximum reaction torque. The tool is always operated at an optimum performance range independently of the character of the material being drilled. The blow added manually operable drilling tool is utilized very efficiently by operating within an optimum performance range. The optimized drilling output shortens the time period necessary for preparing a receiving borehole for the installation of a dowel. This makes the operation of the tool even more economical. Since the evaluation unit is connected to the memory unit, where various rpm ranges or ideal rpms are stored, and since the control arrangement is designed in such a way that in accordance with the evaluation unit these rpm ranges can be automatically adjusted subsequently and varied with increased rpms, the discovery of the optimum rpm together with the associated maximum reaction torque can take place in a very short time period after the control arrangement is activated by the tool operator. The regulation of the optimum rpm occurs independently of the operator. The operator must activate the control arrangement only once, by means of a push bottom. After such activation, control proceeds fully automatically without any further action by the operator. He can tell by the changed noise levels of the motor that any control action is taking place.

We claim:

1. A percussion blow added manually operable drilling tool, comprising a housing (2), a drill bit chuck (9) having an axis of rotation and mounted on said housing (2), an electric motor (3) within said housing for rotating said chuck (9) about said axis of rotation, means for measuring rpms of said chuck, a suspension (13, 14) connecting said electric motor (3) to said housing, a percussion blow mechanism (5) for applying percussion blows periodically at selected translation angles to a bit secured in said chuck, means located within said housing for detecting and measuring reaction torque values between said electric motor and said housing based on a range of rpms in accordance with a selected translation angle and for evaluating the measured reaction torque values and comparing the measured reaction torque values to measured rpms of said range of rpms of said chuck for identifying the measured rpm corresponding to a detected highest measured reaction torque value for regulating and maintaining the chuck rpm at the rpm corresponding to the detected highest measured reaction torque so that during drilling tool operation the reaction torque value measured at said electric motor corresponds to the detected highest measured reaction torque value, said means for detecting and measuring reaction torque values comprising a control device (C) located within said housing for controlling measured rpms of said chuck, a switch (S) located on said housing for operating said electric motor and activating said control device, a measuring device (12) positioned in said suspension (13, 14) between said housing and said electric motor for measuring reaction torques of said electric motor, said control device (C) being connected to an evaluation unit (E) and the evaluation unit being connected to said measuring device (12) for regulating the rpm of said chuck, and a memory unit for storing ranges of rpm values corresponding to each of the selected translation angles, wherein the control device consecutively retrieves said ranges of rpm values from the memory unit, controls the rotation of the chuck so that a reaction torque value is measured for each rpm value within the range, stores the measured values in the memory unit, and compares the measured reaction torque values within the range of rpm values and among the rpm ranges to determine the rpm with the highest measured reaction torque value, whereby the reaction torque measured by said measuring device at said electric motor (3) during operation of said tool is thereafter maintained by said control device at said highest measured reaction torque value.

2. A drilling tool, as set forth in claim 1, wherein said measuring device (12) comprises one of wire strain gages and load cells positioned at a suspension (13), (14), of said electric motor (3) within said housing (2).

3. A drilling tool, as set forth in claim 1 or 2, wherein said evaluation unit (E) is connected to said memory unit (M) within said housing (2) in which different rpm ranges correspond to the selected translation angle are stored, said control device is arranged so that according to the evaluation unit (E) the rpm ranges are automatically adjusted in accordance with increasing rpms, wherein for each adjusted rpm the corresponding reaction torque value is determined and stored in said memory unit (M) and subsequently regulation proceeds towards an rpm of said chuck (9) corresponding to the highest value of the measured reaction torque.

4. A drilling tool, as set forth in claim 3, wherein the rpm ranges stored in said memory unit (M) correspond to the selected translation angles of 37° to 39°, 46° to 50°, 61° to 65°, and 91° to 98°.

5. A drilling tool, as set forth in claim 1 or 2, wherein said evaluation unit (E) is connected to a memory unit (M) within said housing (2) in which different ideal rpms are stored, and the ideal rpms are automatically adjusted and the rpm of the chuck (9) can be varied respectively within a range of ±10% by the control device (C) in accordance with the evaluation unit (E), whereby associated reaction torque values measured and stored in the memory unit (M), and subsequently the rpm of the chuck (9) can be regulated to the rpm at which the highest reaction torque value was observed.

6. A drilling tool, as set forth in claim 5, wherein the ideal rpms correspond to the selected translation angles of 38°, 48°, 63°, and 95° with a tolerance of ±1°.

7. A drilling tool, as set forth in claim 6, wherein said evaluation unit (E) includes a microprocessor (P) for periodically monitoring the adjustment of the rpm of said chuck (9) in accordance with the measured reaction torques values and, if necessary, causes a correcting regulation.

* * * * *